US006710756B2

(12) United States Patent
Zimlich

(10) Patent No.: US 6,710,756 B2
(45) Date of Patent: Mar. 23, 2004

(54) MATRIX ADDRESSABLE DISPLAY HAVING PULSE NUMBER MODULATION

(75) Inventor: David A. Zimlich, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/925,116

(22) Filed: Aug. 8, 2001

(65) Prior Publication Data

US 2001/0045922 A1 Nov. 29, 2001

Related U.S. Application Data

(62) Division of application No. 09/137,769, filed on Aug. 20, 1998, now Pat. No. 6,359,604.

(51) Int. Cl.[7] ..... G09G 3/22

(52) U.S. Cl. ..... 345/75.2; 345/74.1; 345/691; 345/690

(58) Field of Search ..... 345/74.1, 75.2, 345/76, 77, 204, 690, 208, 213, 691; 315/169.1, 169.3

(56) References Cited

U.S. PATENT DOCUMENTS 5,187,578 A 2/1993 Kohgami et al. ..... 358/168
5,894,293 A * 4/1999 Hush et al. ..... 345/74.1
6,069,451 A * 5/2000 Hush et al. ..... 315/164
6,072,448 A * 6/2000 Kojima et al. ..... 345/60
6,107,999 A * 8/2000 Zimlich et al. ..... 345/204
6,184,619 B1 2/2001 Yamazaki et al. ..... 313/495

* cited by examiner

*Primary Examiner*—Kent Chang
(74) *Attorney, Agent, or Firm*—Dorsey & Whitney LLP

(57) ABSTRACT

A current controlled field emission display includes a controller that provides a pair of pulsed clocking signals that allows current to flow from ground potential to an emitter in the field emission display during each clocking signal pulse. The number of electrons, and thus the intensity of the light will depend upon the number N of clocking signal pulses during an activation interval. In one embodiment, each of the pulsed signals includes a number N of pulses that corresponds to a desired intensity of pixels. The pulsed signals are formed by gating a clock signal in response to digital data applied to the display such that the transfer of electrons is controlled directly by the digital data. In another embodiment, the pulsed signals are produced by comparing a decoded image signal to counts from a high speed counter.

6 Claims, 4 Drawing Sheets

MATRIX ADDRESSABLE DISPLAY HAVING PULSE NUMBER MODULATION

CROSS-REFERENCE TO RELATED APPLICATION

This application is a divisional of pending U.S. patent application No. 09/137,769, filed Aug. 20, 1998 now U.S. Pat. No. 6,359,604.

TECHNICAL FIELD

The present- invention relates to image displays, and more particularly to pulsed current control in image displays.

BACKGROUND OF THE INVENTION

Flat panel displays are widely used in a variety of applications, including computer displays. One type of device well-suited for such applications is the field emission display. Field emission displays typically include a generally planar substrate having an array of projecting emitters. In many cases, the emitters are conical projections integral to the substrate. Typically, the emitters are grouped into emitter sets where the bases of the emitters in each set are commonly connected.

A conductive extraction grid is positioned above the emitters and driven with a voltage of about 30V–120V. The emitters are then selectively activated by providing a current path from the bases to the ground. Providing a current path to ground allows electrons to be drawn from the emitters by the extraction grid voltage. If the voltage differential between the emitters and extraction grid is sufficiently high, the resulting electric field causes the emitters to emit electrons.

The field emission display also includes a display screen mounted adjacent the substrate. The display screen is formed from a glass plate coated with a transparent conductive material to form an anode biased to about 1kV–2kV. A cathodoluminescent layer covers the exposed surface of the anode. The emitted electrons are attracted by the anode and strike the cathodoluminescent layer, causing the cathodoluminescent layer to emit light at the impact site. The emitted light then passes through the anode and the glass plate where it is visible to a viewer.

The brightness of the light produced in response to the emitted electrons depends, in part, upon the number of electrons striking the cathodoluminescent layer in a given interval. The number of emitted electrons depends in turn upon the magnitude of current flow to the emitters. The brightness of each area can thus be controlled by controlling the current flow to the respective emitter. The light emitted from each of the areas thus becomes all or part of a picture element or "pixel."

In a typical analog voltage control approach, current flow to the emitters is controlled by controlling the voltage applied to either the emitters or the extraction grid to produce a selected voltage differential between the emitters and the extraction grid. The electric field intensity between the emitters and the extraction grid is the voltage differential divided by the distance between the emitters and the extraction grid. The magnitude of the current to the emitters then corresponds to the intensity of the electric field.

As is known, analog voltage control approaches can be relatively complex to implement, especially in displays that typically receive digital image signals, such as displays intended for laptop computers as well as large "passive matrix" displays. A passive matrix field emission display is a display in which a single driving circuit is provided for a group of emitters, such as a row or column of emitters. In contrast, in an "active matrix" field emission display, a respective driving circuit is provided for each emitter or group of emitters that are in the same pixel of the display.

Analog voltages can also be difficult to control precisely due to variations in component values caused by temperature, age, or other conditions. In large arrays, variations in transistors, emitters or the extraction grid can result in non-uniform display characteristics or otherwise detrimentally affect performance.

One approach to reducing this problem employs pulse-width modulation. In this approach, the image signal is converted to a pulse-width modulated signal where the pulse width is determined by the value of the image signal. Then, the emitter is activated by grounding the emitter during an "ON" time corresponding to the width of the pulse. Pulse width modulation typically requires conversion of the input signal from an analog signal to a pulse width modulated signal. Typical techniques for such conversion may introduce errors and increase the complexity of the driving circuitry. Moreover, typical implementations of pulse width modulation require precise control of timing.

SUMMARY OF THE INVENTION

In accordance with the invention, a control circuit modulates the number of times that an emitter or group of emitters in the same pixel emits light during an activation interval to control the intensity of the pixel. Each pulse of a clocking signal couples the emitter or group of emitters to a voltage having a value that causes the emitter or group of emitters to emit electrons. The number of electrons emitted in a selected activation interval is controlled by controlling the number of such pulses during the activation interval.

The number of pulses of the clocking signal during each activation interval is determined in response to an image signal. In one embodiment where the image signal is a digital signal, the display includes a plurality of clock sources, each producing a respective set of pulses. Pulses from each clock source are selectively passed or blocked based upon the state of a respective bit of the digital image signal. Then, all of the passed pulses are accumulated to form the clocking signal.

In another embodiment, the image signal is decoded to produce a binary number. At the beginning of each activation interval, a counter begins decrementing responsive to a continuous clock signal. A comparing circuit compares the count to the binary number and, when the count matches the binary number, the comparing circuit outputs a disable pulse. From the beginning of the activation interval until the disable pulse arrives, a pulse source outputs a series of equally spaced pulses of the clocking signal. Consequently, the pulse source outputs a number of clocking signal pulses corresponding to the binary number.

The pulse number modulation circuit and method is preferably used in a passive field emission display such as a display in which a respective driving circuit is provided for the emitters or groups of emitters in each column of the display, and the extraction grids in each row are coupled together. However, the pulse number modulation circuit and method may also be used in an active field emission display in which a respective driving circuit is provided for each emitter or group of emitters in the same pixel.

DETAILED DESCRIPTION OF THE INVENTION

Figure 1:
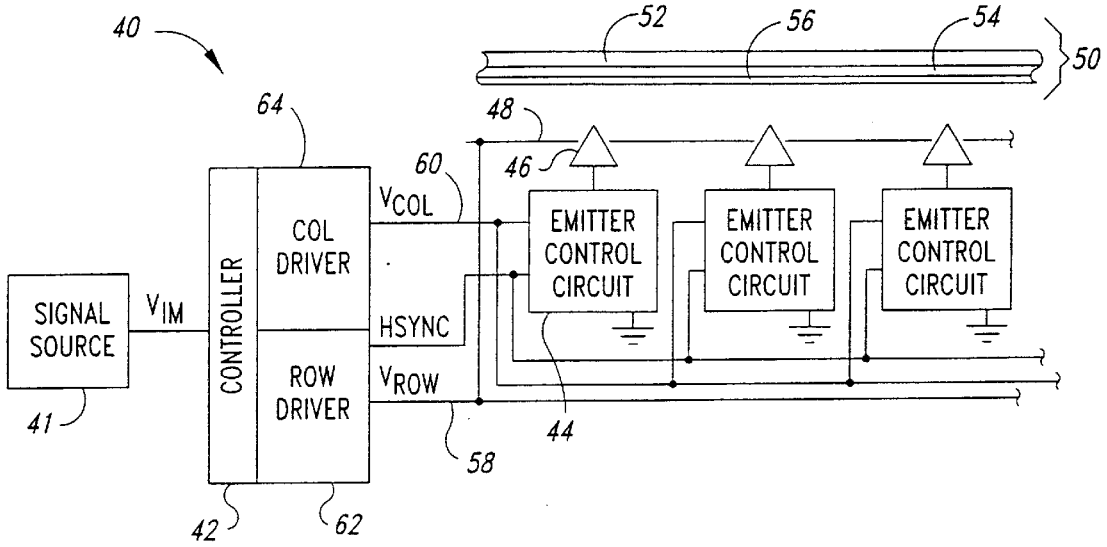
FIG. 1 is a schematic representation of a portion of a field emission display according to the invention showing a group of emitters controlled by current control circuits.

As shown in FIG. 1, a display device 40, which may be part of a television, computer display, or similar device, produces an image responsive to an image signal VIM from a signal source 41. The display device 40 includes a controller 42 that receives the image signal VIM and controls an array of emitter control circuits 44, each coupled to a respective emitter 46. While the array is represented by only three control circuits 44 and emitters 46 for clarity of presentation, it will be understood that typical arrays include several hundred control circuits 44 and emitters 46 arranged in rows and columns. Also, although each emitter 46 is represented by a single emitter for clarity, one skilled in the art will recognize that the term emitter may refer to a single emitter or a group of commonly connected emitters that form a single pixel.

The emitters 46 are each aligned with a respective aperture formed in a conductive extraction grid 48 adjacent a display screen 50. In a typical passive display, the emitters 46 in each column are connected to each other and driven by the same control circuit 44, and the extraction grids 48 in each row are connected to each other and driven by the same row signal. The screen 50 is a conventional screen that may be formed from a glass plate 52 coated with a transparent, conductive anode 54 which is coated, in turn, by cathodoluminescent layer 56. As is known, during typical operation, the extraction grid 48 is biased to approximately 30–100V and the anode 54 is biased to approximately 1–2 kV.

In operation, a row driver 62 within the controller 42 selectively activates each row of extraction grids 48 through a row line 58, and a column driver 64 within the controller 42 selectively activates each column of emitters 46 by selectively controlling the respective control circuits 44 through column lines 60. (For purposes of brevity and clarity, only one emitter 46 in each of three columns of emitters is shown in FIG. 1, and only one row of extraction grids 48 is shown in FIG. 1). Responsive to signals from the column drivers 64, the control circuit 44 couples its respective column of emitters 46 to ground, and the row driver 62 provides a relatively high voltage to a row of extraction grids 48. At any single time, one of the emitters 46 in the column of emitters 46 that is coupled to ground will be in a row of extraction grids 48 that receives the relatively high voltage, and the voltage differential between the emitter 46 and the extraction grid 48 will then be sufficient to extract electrons from the emitter 46. The extracted electrons travel toward the anode 54 where they strike the cathodoluminescent layer 56 and cause light emission at the impact site. Because the intensity of the emitted light corresponds in part to the number of electrons striking the cathodoluminescent layer 56 during a given activation interval, the intensity of light can be controlled by controlling the electron flow to the emitter 46. Although the controller 42 is shown in FIG. 1 as being controlled solely by the image signal $V_{IM}$,it will be understood that several other signals will also be used to cause the row driver 62 to sequentially apply a row signal $V_{ROW}$ to each row of extraction grids 48, and to cause the column driver 64 to sequentially activate the emitter control circuit 44 for each column with the proper timing relationships.

Control of electron flow by the emitter control circuit 44 will now be described with reference to FIGS. 2 and 3. As shown in FIG. 3, the control circuit 44 is formed by a PMOS pull-up transistor 66 coupled between a voltage $V_{PP}$ and an emitter node 69 and an NMOS driving transistor 68 coupled between the emitter node 69 and ground potential.

Figure 2:
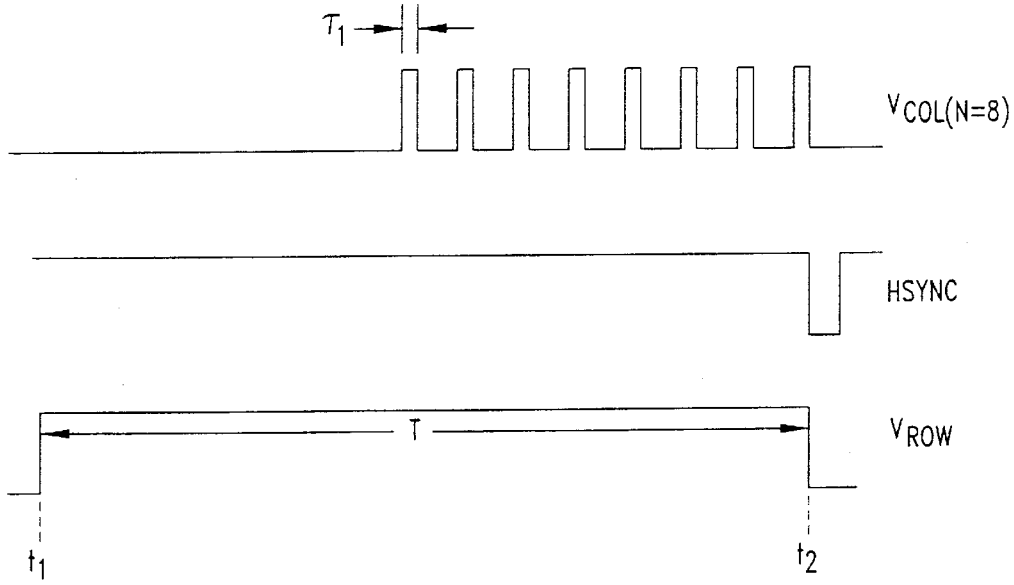
FIG. 2 is a timing diagram showing column, row and gating signal for controlling an emitter of the display of FIG. 1.
Figure 3:
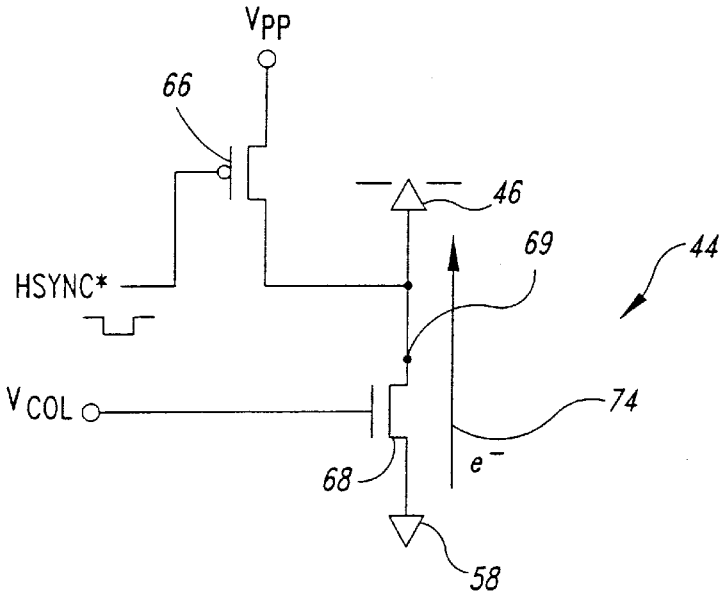
FIG. 3 is a schematic of one of the emitter control circuits of FIG. 1 coupled to an emitter.

The emitter control circuit 44 is controlled by a $V_{COL}$ signal and an HSYNC signal from the controller 42, as shown in FIG. 2. A third signal $V_{ROW}$, also shown in FIG. 2, is applied to each row of extraction grids 48. At time $t_1$ the row driver 62 applies the row signal $V_{ROW}$ to a row of extraction grids 48. The row signal $V_{ROW}$ ends at time $t_2$. The row signal $V_{ROW}$ is a relatively high voltage, e.g., between 30 and 100 volts. The interval T between $t_1$ and $t_2$ during which the row signal $V_{ROW}$ is high will be referred to herein as the activation interval. Typically, the activation interval T is defined by a horizontal sync component of the image signal.

The signal $V_{COL}$ from column driver 64 drives the gate of the driving transistor 68. In this embodiment, the clocking signal $V_{COL}$ is a pulsed signal that has a variable number N of pulses during the activation period T. The pulses begin at some time during the activation period and end at the end of the activation period at time $t_2$. The magnitude of the number N corresponds to the image signal $V_{IM}$. One skilled in the art will recognize that, where the image signal $V_{IM}$ is a digital signal, the number N will typically be determined by decoding the digital image signal $V_{IM}$. Generation of the clocking signal $V_{COL}$ will be described in greater detail below with reference to FIGS. 4 and 6.

The HSYNC signal is a pulsed voltage occurring at the end of the activation period that drives the gate of the pull-up transistor 66. The magnitude of the HSYNC signal is sufficiently low to turn ON the pull-up transistor 66.

In response to each pulse of the $V_{COL}$ signal, the transistor 68 turns ON, thereby providing a path from ground to the emitter 46. The transistor 68 is turned ON during an interval $T_1$ defined by the width of each pulse of the signal $V_{COL}$. When the transistor 68 is ON, electrons flow from the ground to the emitter 46, as indicated by an arrow 74 in FIG. 3.

At the end of each interval $T_1$ the signal $V_{COL}$ returns low, thereby turning OFF the transistor 68. The flow of electrons to the emitter 46 is then interrupted so that electrons are no longer emitted from the emitter 46. However, in practice, because of capacitance in conductors (not shown) coupling the emitters 46 in each row to each other, the emitters 46 may continue to emit electrons for a short time after the transistor 66 turns OFF. For this reason, the HSYNC signal is used to turn ON the pull-up transistor 68 so that the voltage $V_{PP}$ is applied to the emitter 46 to prevent further election emission from the emitter 46.

The activation interval T is substantially longer than the interval $T_1$. Consequently, many pulses of the clocking signal $V_{COL}$ can be provided within one activation interval T. For example, 8 pulses are shown in the activation interval T of FIG. 2. To control the brightness of a pixel the column driver 64 controls the number N of pulses in the activation interval T.

The total number of electrons emitted by an emitter 64 during the activation interval T will be proportional to the number N of pulses provided during the activation interval T. To control the brightness, the controller 42 can control the number N of pulses during the activation interval T.

Although an emitter control circuit 44 composed of a drive transistor 68 and a pull-up transistor 66 is shown in FIG. 3, a wide variety of other circuits may also be used.

Figure 4:
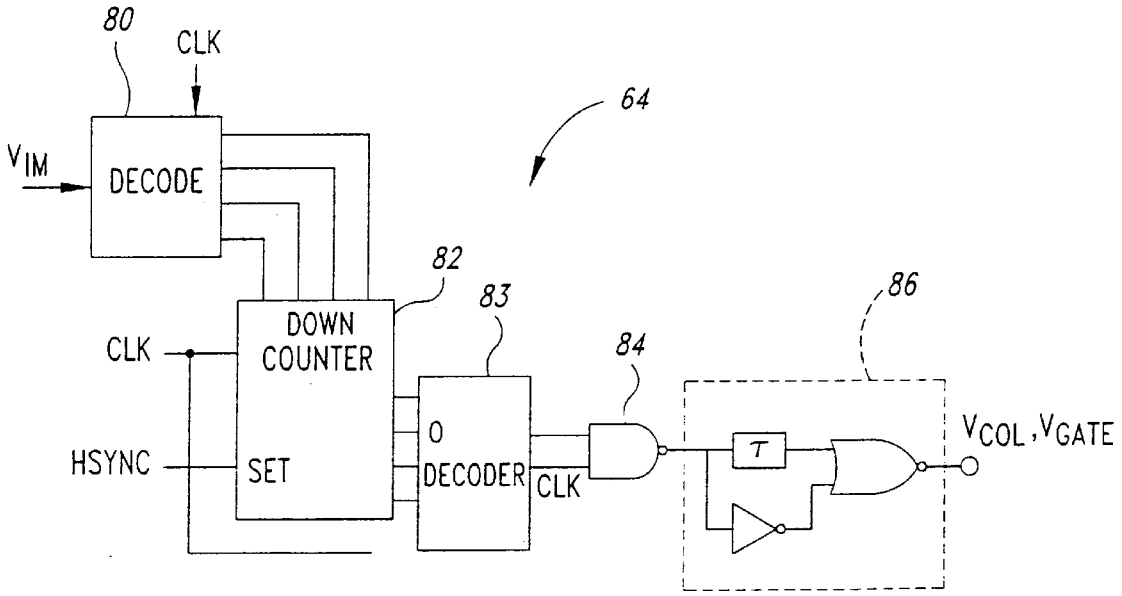
FIG. 4 is a schematic of an embodiment of a column driver of FIG. 1.

The generation of N pulses responsive to the image signal $V_{IM}$ will now be described with reference to FIG. 4. As shown in FIG. 4, one embodiment of the column driver 64 for generating N pulses within the activation interval T includes a decoder 80, a counter 82, and a transition detector 86. This embodiment is particularly advantageous for applications where the image signal $V_{IM}$ is a digital signal because the column driver 64 would then require no analog-to-digital or digital-to-analog converters. The counter 82 is preferably a conventional high-speed down-counter driven by a system clock signal CLK and set to the output of the decoder 80 by the horizontal sync signal HSYNC. The decoder 80 may be a high speed integrated device, such as an application specific integrated circuit (ASIC), that receives the image signal VIM and the clock signal CLK and outputs a four-bit count inversely corresponding to image information in the image signal $V_{IM}$ at each pulse of the clock signal CLK. The four-bit count loaded into the counter 82 by the HSYNC pulse is used by the counter 82 as a starting count. The counter 82 outputs a four-bit count that decrements from the starting count to zero responsive to the clock signal CLK for each horizontal scan, i.e., each activation interval T. The count from the counter 82 is applied to a zero count decoder 83 which outputs a low until the terminal count of zero is reached. The decoder then outputs a high to enable a NAND gate 84. The NAND gate, when enabled, couples the CLK signal to a transition detector 86.

The decoder 80 outputs a starting count that is inversely proportioned to the magnitude of the signal $V_{IM}$. Thus, an image signal $V_{IM}$ having a large magnitude will cause the decoder 80 to output a starting count at close to "0000." As a result, the NAND gate 84 will be enabled at or near the start of the activation interval. An image signal $V_{IM}$ having a small magnitude will cause the decoder 80 to output a starting count at or close to "1111." As a result, the NAND gate 84 will be enabled at or near the end of the activation interval T.

The output from the NAND gate 84 is applied to a transition detector 86 that outputs a high going pulse responsive to each high going transition of the CLK signal coupled through the NAND gate 84. Thus, if the starting count of the counter 82 is "0000," the transition detector 86 will output $V_{COL}$ pulses for the entire activation interval T. Conversely, if the starting count of the counter is "1111," the transition detector 86 will not output any $V_{COL}$ pulses during the activation interval T. If the starting count of the counter 82 is "0111," the transition detector 86 will output $V_{COL}$ pulses for only the later half of the activation interval T.

Figure 5A:
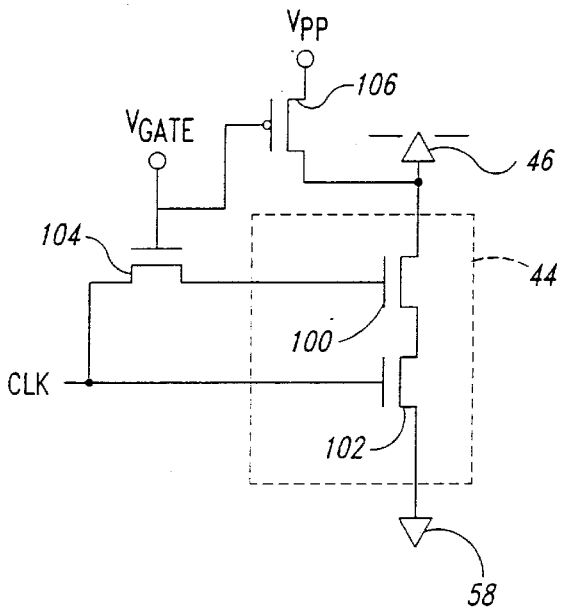
FIG. 5B is a signal timing diagram of selected signals in the control circuit of FIG. 5A.

FIG. 5A shows another embodiment of the control circuit 44, including serially connected first and second transistors 100, 102 that allow simplification of the signals applied to the transistors 100, 102. When both of the transistors 100, 102 are ON, the emitter 46 is pulled substantially to ground.

Figure 5B:
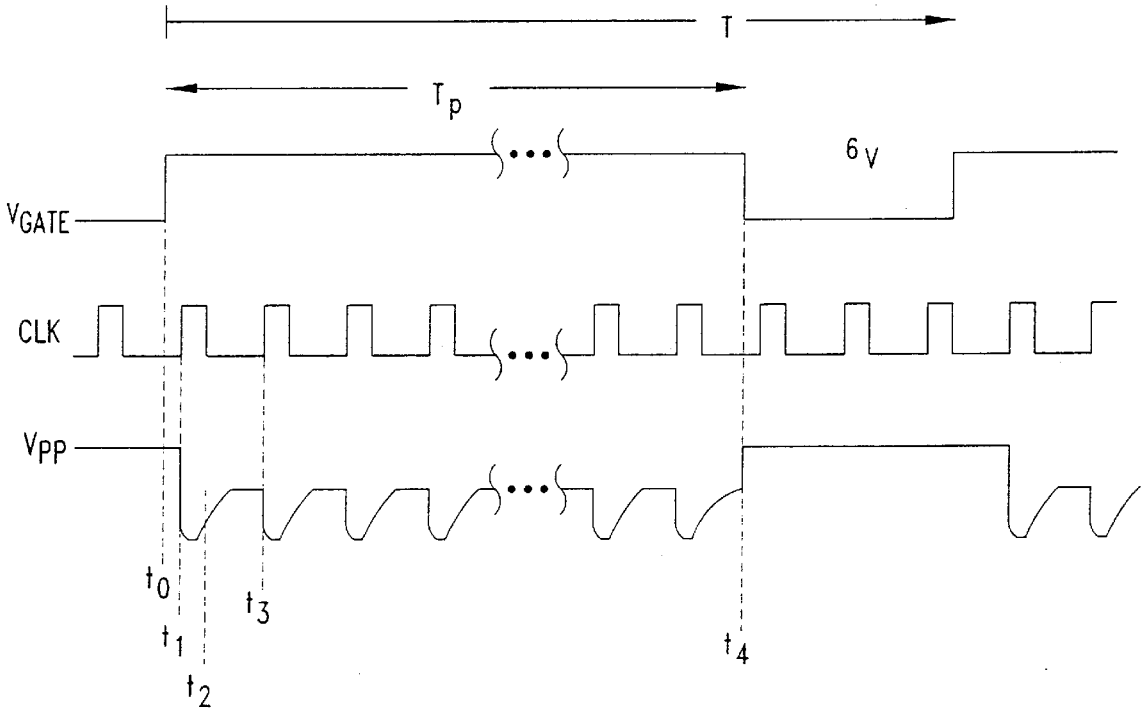

As shown in FIG. 5B, a clock signal CLK continuously provides pulses to the gate of the transistor 102 and to the drain of an NMOS transistor 104. The gate of the transistor 100 is driven with a gating signal $V_{GATE}$. As shown in FIG. 5B, the gating signal $V_{GATE}$ has a pulse width $T_P$ corresponding to the magnitude of the image signal $V_{IM}$. The gating signal $V_{GATE}$ is also applied to a PMOS pull-up transistor 106, which couples a voltage $V_{PP}$ to the emitter 46 when the transistor 106 is ON.

At the beginning of an activation interval T, the gating signal $V_{GATE}$ transitions high at time to turn ON the transistor 104 and to turn OFF the pull-up transistor 106. At time $t_1$, a pulse of the clock signal CLK turns ON the transistor 102 and is coupled through the transistor 104 to turn ON the transistor 100. Current then flows from the emitter 46 to ground, as explained above with reference to FIG. 3. The ON transistors 100, 102 quickly pull the voltage on the emitter 46 to ground, as shown in the third graph of FIG. 5B. Current flow through the emitter 46 is limited primarily by the channel resistance of the transistors 100, 102 although an additional series resistance may be added in some applications to further limit current flow.

At time $t_2$, the first CLK pulse terminates, thereby turning OFF the transistors 100, 102 and isolating the emitter 46 from ground.

At time $t_3$ and at regular intervals thereafter, pulses of the clock signal CLK turn on the transistors 100, 102 and provide further electrons to the emitter 46 as described above. At time $t_4$, the gating signal $V_{GATE}$ falls, thereby turning OFF the transistor 104. Because the transistor 104 is OFF, no further pulses of the clock signal CLK are coupled to the transistor 100 even though the CLK pulses continue to periodically turn ON the transistor 102. The falling edge of the $V_{GATE}$ signal also turns ON the pull-up transistor 100 to apply the voltage $V_{PP}$ to the emitter 46. The voltage $V_{PP}$ has a magnitude that is sufficient to prevent further emission of electrons from the emitter 46. Thus, like the embodiment of FIG. 4, the control circuit of FIG. 5A periodically couples the emitter 46 to ground a number of counts N corresponding to the output of the image signal $V_{IM}$.

As noted previously, the brightness of each pixel will correspond to the number of electrons emitted during the activation interval T. In the embodiment of FIGS. 5A, 5B, the number of electrons emitted in each interval will depend upon the number of pulses of the clock signal CLK within the variable width pulse of the gating signal $V_{GATE}$. One skilled in the art will recognize that the duration of the gating signal $V_{GATE}$ need not be precise since the intensity will vary only when the variable width pulse changes sufficiently to eliminate or add pulses of the clock signal CLK. Additionally, one skilled in the art will recognize that the intensity may be alternately controlled by varying the frequency of the clock signal CLK. For example, if the frequency of the clock signal CLK is increased sufficiently, additional pulses will occur during the variable width of the gating signal $V_{GATE}$ and the intensity will increase. Thus, the clock signal CLK may be varied to control the overall intensity of the display while the relative intensities of the pixels can be controlled by controlling the interval $T_P$ of the variable width pulse.

Figure 6:
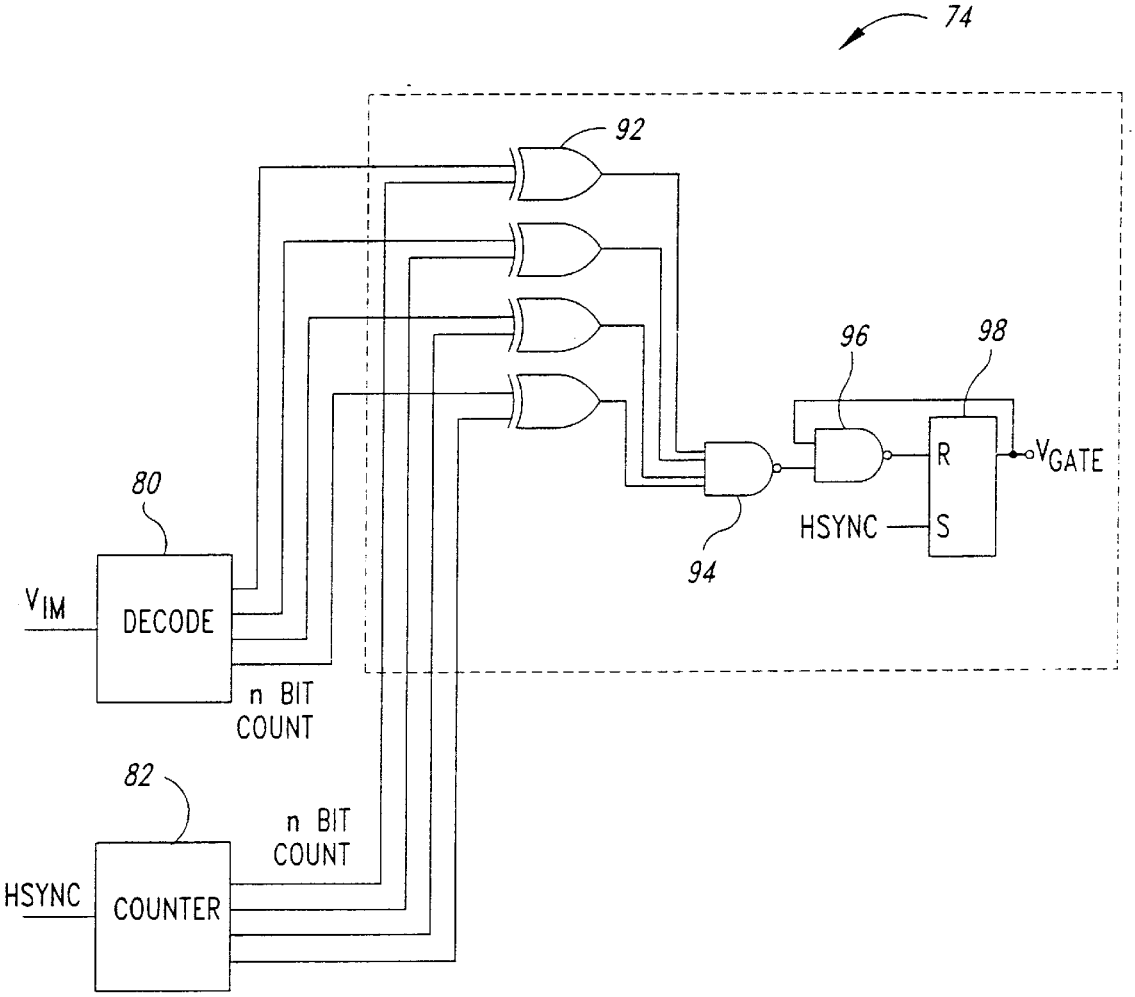
FIG. 6 is a schematic of a second embodiment of the Q clock source including an output latch.

FIG. 6 shows one embodiment of a column driver 74 that produces the gating signal $V_{GATE}$. Like the column driver 64 of FIG. 4, the column driver 74 of FIG. 6 includes the decoder 80 that receives the image signal VIM and counter 82 that receives the clock signal CLK. The decoder 80 outputs a binary number having a magnitude of the image signal $V_{IM}$. The counter 82 is reset to zero at the end of each row by the HSYNC signal. Rather than using the decoder output as an input to the counter 82, the column driver 74 of FIG. 6 combines outputs of the decoder 80 and counter 82 at respective exclusive OR gates 92. The outputs of the exclusive OR gates 92 are then input to a four-input NAND gate 94. One skilled in the art will recognize that each exclusive OR gate 92 will output a high signal only when its respective bit from the counter 82 matches a bit from the decoder 80. Thus, the four-input NAND gate 94 receives at least one low signal unless all of the bits of the counter 82 match respective bits from the decoder 80. Consequently, the four-input NAND gate 94 will output a high signal until the bits from the counter 82 match the corresponding bits from the decoder 80. Because the counter bits are a binary count, the output from the four-input NAND gate 94 will transition low at the first count where the output of the counter 82 matches the output of the decoder. The NAND gate 94 thus provides a transition indicating that the counter output has reached the value indicated by the image signal $V_{IM}$. The period during which the NAND gate 94 outputs a high has a duration corresponding to the magnitude of the image signal $V_{IM}$.

The output of the four-input NAND gate 94 is applied to a comparing NAND gate 96. As will be described below, the second input to the comparing NAND gate 96 is high initially. Therefore, the output of the comparing NAND gate 96 is low until the output of the four-input NAND gate 94 transitions low. When the output of the four-input NAND gate 94 transitions low, the output of the comparing NAND gate 96 transitions high to drive a reset input of a latch 98 high, thereby resetting the latch 98. When the latch 98 is reset, its output, which generates the gating signal $V_{GATE}$, transitions low. Thus, $V_{GATE}$ is high for a period corresponding to the magnitude of the image signal. The $V_{GATE}$ signal at the output of the latch 98 is also applied to the second input to the comparing NAND gate 96. Thus, when the $V_{GATE}$ signal transitions low, the output of the comparing NAND gate 96 transitions high, thereby preparing the latch 98 to be set at the next pulse of the horizontal sync signal HSYNC.

While the principles of the invention have been illustrated by describing various structures for controlling current to the emitters 46, various modifications may be made without deviating from the spirit and scope of the invention. Accordingly, the invention is not limited except as by the appended claims.

What is claimed is:

1. A method of supplying electrons from an electron source to an emitter in a field emission display in response to an image signal, the method comprising:

determining a pulse count for a display interval in response to the image signal;

producing the determined number of pulses during the display interval; and supplying electrons to the emitter from the electron source during each pulse.

2. The method of claim 1 wherein producing the determined number of pulses comprises:

providing a plurality of source pulses; and ignoring all of the source pulses other than the determined number of such pulses.

3. A method of supplying a controlled current to an emitter in a field emission display to generate a portion of an image having an intensity defined by an intensity control signal, the method comprising:

selecting a duration of an activation interval corresponding to the intensity control signal; and during each activation interval, periodically applying electrons to the emitter a number of times corresponding to the duration of the activation interval.

4. The method of claim 3 wherein periodically applying electrons to the emitter comprises:

pulse during a respective pulse interval for the selected number of pulses comprises:

continuously providing periodic source pulses; and coupling the source pulses to the emitter during the activation interval and blocking the source pulses from the emitter after the activation interval.

5. A method of supplying a current to an emitter in a field emission display to generate a portion of an image having an intensity defined by an intensity control signal, the method comprising supplying a quantity of electrons to the emitter a plurality of times during an activation period, the number of times that the quantity of electrons is applied to the emitter during each activation period corresponding to the intensity control signal.

6. The method of claim 5 wherein supplying a quantity of electrons to the emitter comprises coupling the emitter to a reference voltage.

* * * * *

UNITED STATES PATENT AND TRADEMARK OFFICE

CERTIFICATE OF CORRECTION

PATENT NO. : 6,710,756 B2
DATED : March 23, 2004
INVENTOR(S) : David A. Zimlich

It is certified that error appears in the above-identified patent and that said Letters Patent is hereby corrected as shown below:

Column 1,
Line 7, "of pending U.S. patent" should read -- of U.S. patent --

Column 3,
Lines 18 and 20, "signal VIM" should read -- signal $V_{IM}$ --

Column 4,
Line 2, "$V_{IM}$,it will be" should read -- $V_{IM}$, it will be --
Line 58, "transistor 68 so that the" should read -- transistor 66 so that the --

Column 5,
Line 23, "signal VIM" should read -- signal $V_{IM}$ --

Column 6,
Line 6, "at time to turn ON" should read -- at time $t_0$ to turn ON --
Line 60, "signal VIM" should read -- signal $V_{IM}$ --

Signed and Sealed this

Twenty-eighth Day of December, 2004

JON W. DUDAS
*Director of the United States Patent and Trademark Office*